US008136273B2

(12) United States Patent
Kim et al.

(10) Patent No.: US 8,136,273 B2
(45) Date of Patent: Mar. 20, 2012

(54) CLOTHES REFRESHING APPARATUS AND METHOD FOR CONTROLLING THE SAME

(75) Inventors: Jong Seok Kim, Chungcheongnam-do (KR); Si Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 555 days.

(21) Appl. No.: 12/159,945

(22) PCT Filed: Apr. 18, 2007

(86) PCT No.: PCT/KR2007/001860

§ 371 (c)(1),
(2), (4) Date: Nov. 3, 2008

(87) PCT Pub. No.: WO2007/126225

PCT Pub. Date: Nov. 8, 2007

(65) Prior Publication Data

US 2009/0151205 A1 Jun. 18, 2009

(30) Foreign Application Priority Data

Apr. 27, 2006 (KR) ..... 10-2006-0037889

(51) Int. Cl.
*D06F 58/10* (2006.01)
*D06F 58/26* (2006.01)

(52) U.S. Cl. ..... 38/2; 38/1 A; 38/14

(58) Field of Classification Search ..... 38/1 A, 38/1 R, 14, 2, 3; 68/222
See application file for complete search history.

(56) References Cited

U.S. PATENT DOCUMENTS

| | | | | |
|---|---|---|---|---|
| 3,512,379 | A * | 5/1970 | Rasmussen et al. | 68/240 |
| 3,752,373 | A * | 8/1973 | Smith | 223/51 |
| 4,471,537 | A * | 9/1984 | Meda | 34/77 |
| 5,094,020 | A | 3/1992 | Wingfield et al. | |
| 5,152,077 | A * | 10/1992 | Liang | 34/77 |
| 5,433,919 | A | 7/1995 | Baltes | |
| 5,561,880 | A | 10/1996 | Allen et al. | |
| 5,755,040 | A * | 5/1998 | Ou | 34/202 |
| 6,925,737 | B2 * | 8/2005 | Bolduan et al. | 38/1 A |
| 7,377,052 | B2 * | 5/2008 | Maruca | 34/201 |
| 7,721,368 | B2 * | 5/2010 | Kim et al. | 8/158 |
| 2005/0034489 | A1 | 2/2005 | Oh et al. | |

FOREIGN PATENT DOCUMENTS

| | | |
|---|---|---|
| CN | 2044612 | 9/1989 |
| CN | 1037557 | 11/1989 |
| CN | 1580371 | 2/2005 |
| EP | 1 544 345 | 6/2005 |
| GB | 1 414 041 | 11/1975 |
| JP | 4144598 | 5/1992 |
| JP | 11189968 | 7/1999 |
| WO | WO 2005/001191 | 1/2005 |

OTHER PUBLICATIONS

Chinese Office Action issued in CN Application No. 200780011466X dated Feb. 12, 2010.

Supplementary European Search Report issued in EP Application No. EP 07 74 6023 dated Dec. 1, 2010.

* cited by examiner

*Primary Examiner* — Ismael Izaguirre
(74) *Attorney, Agent, or Firm* — KED & Associates, LLP

(57) ABSTRACT

A fabric refreshing apparatus is provided. The refreshing apparatus may include a case, and a receiving compartment, provided in the case to receive fabric articles. The apparatus may also include a steam generator, a fluid supply tank, and a drain tank. The steam generator supplies steam to receiving compartment to steam the fabric articles. The fluid supply tank supplies fluid the steam generator. The drain tank collects residual fluid from the steam generator.

20 Claims, 6 Drawing Sheets

[Fig. 1]
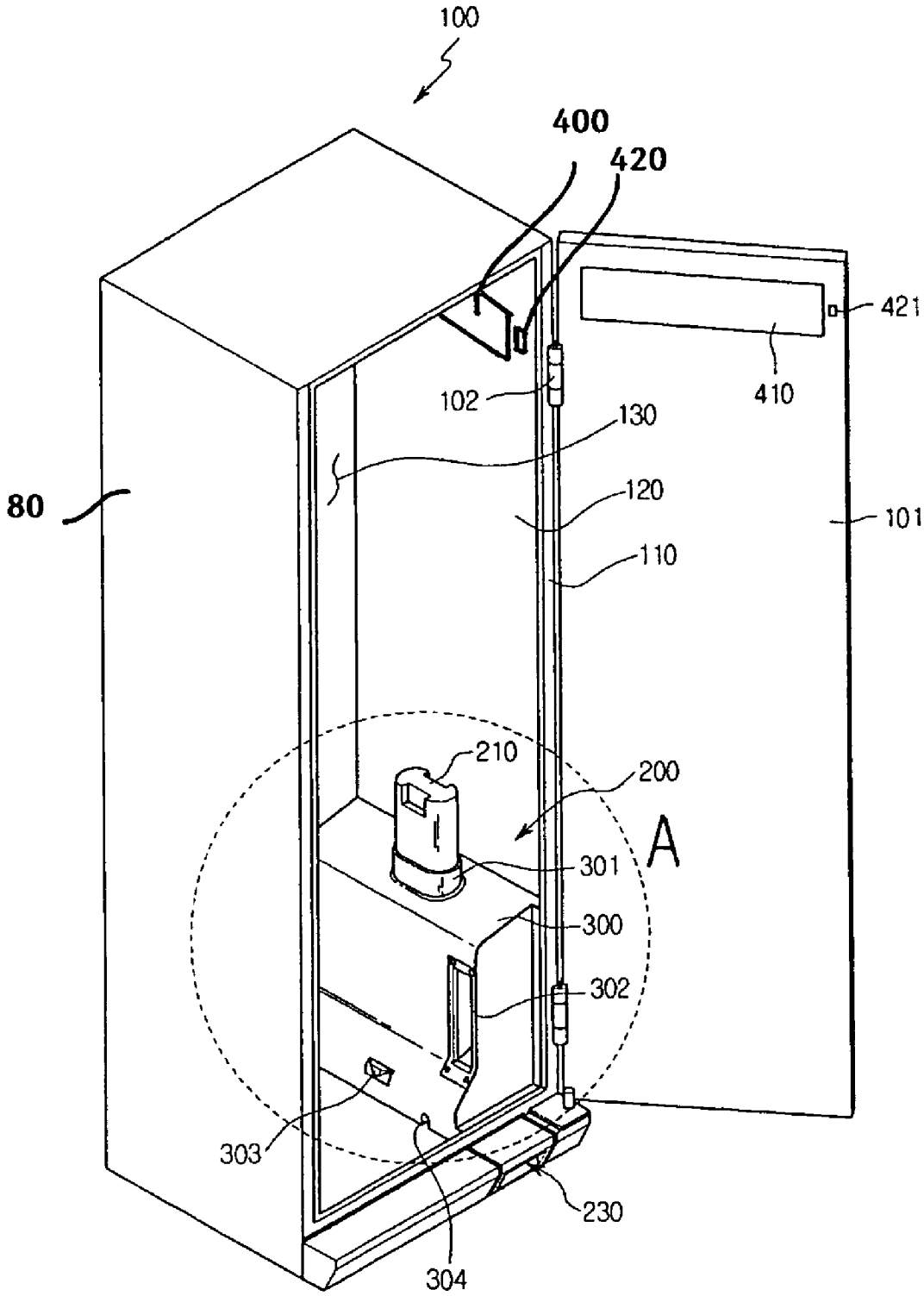

[Fig. 2]
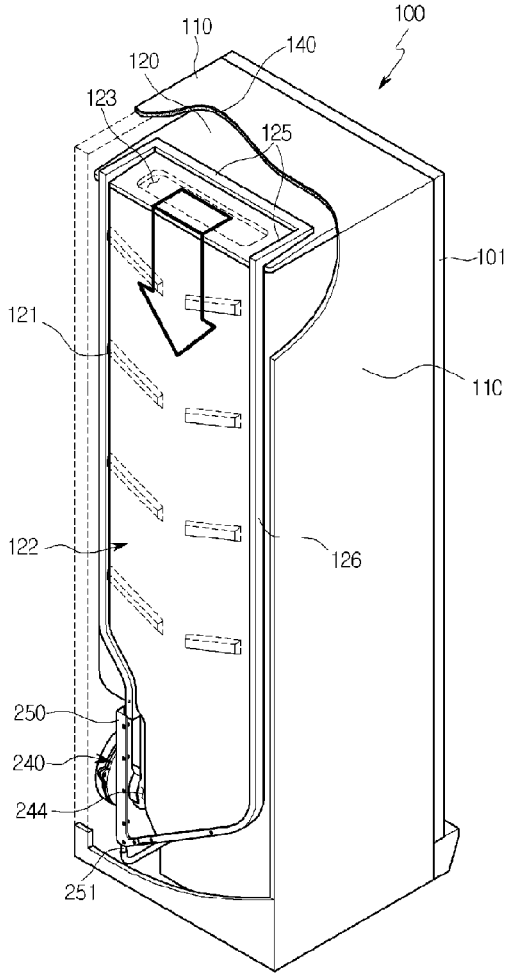
[Fig. 3]
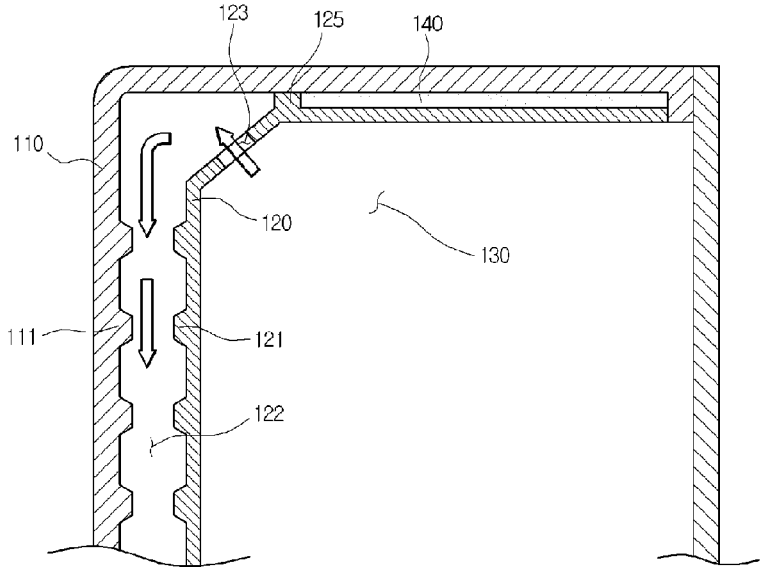

[Fig. 4]
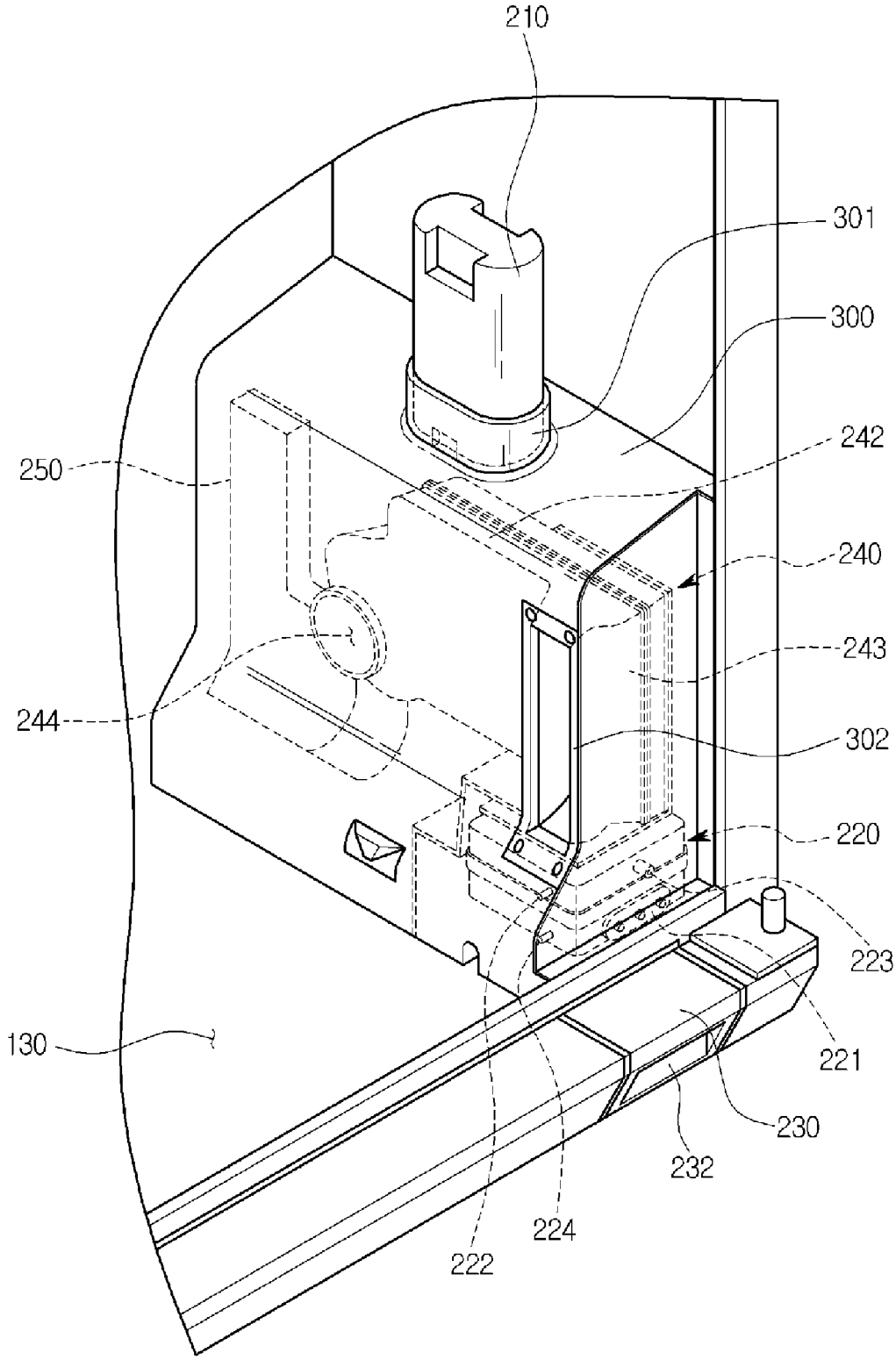

[Fig. 5]
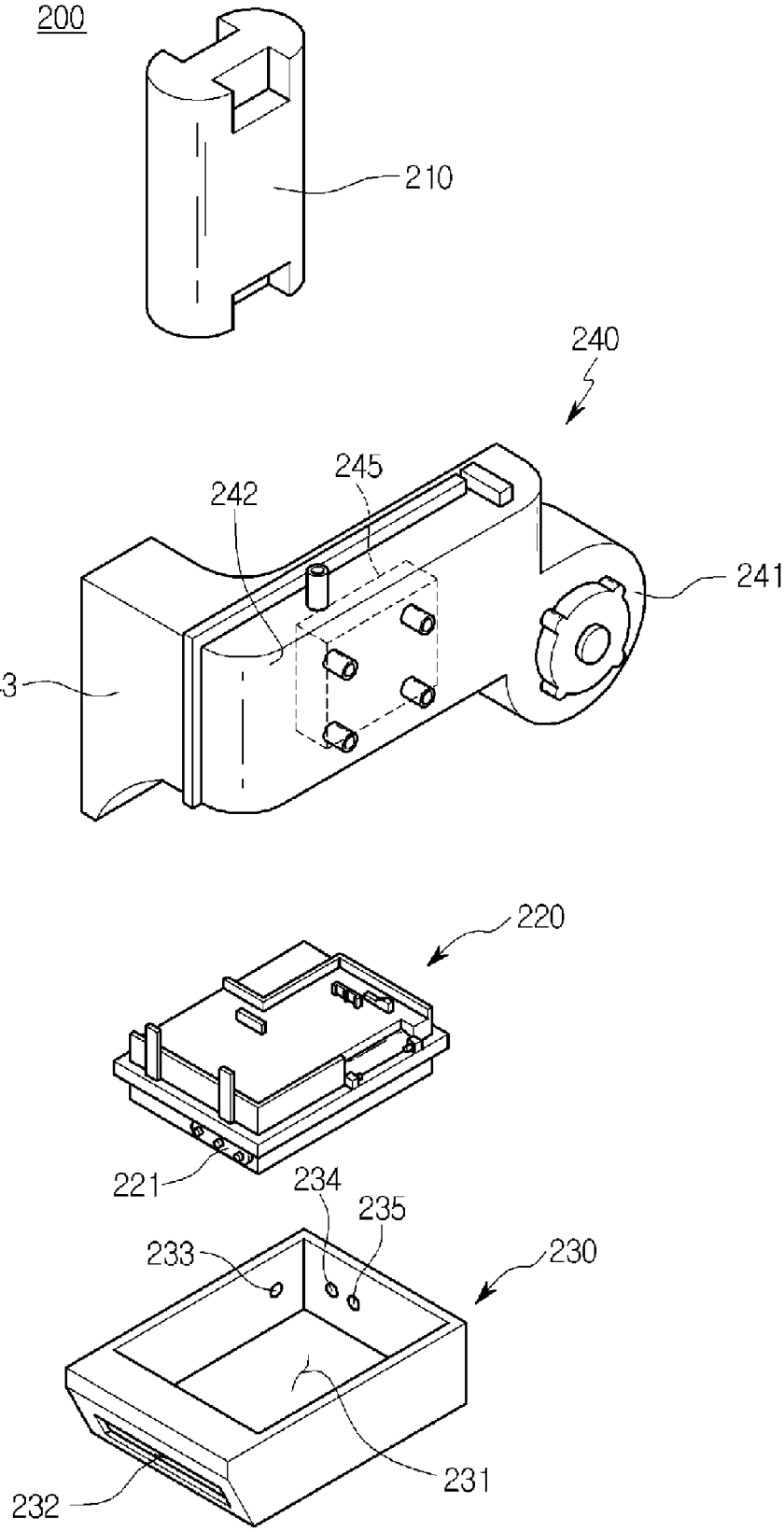

[Fig. 6]
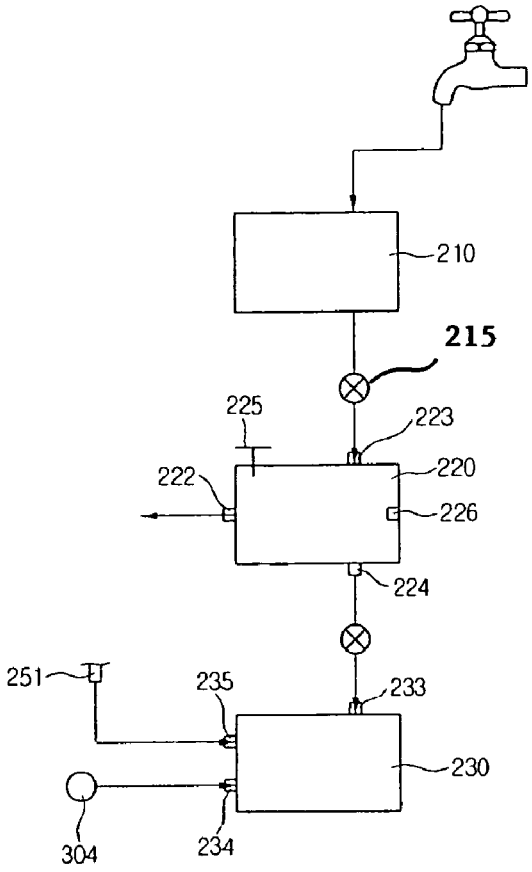
[Fig. 7]
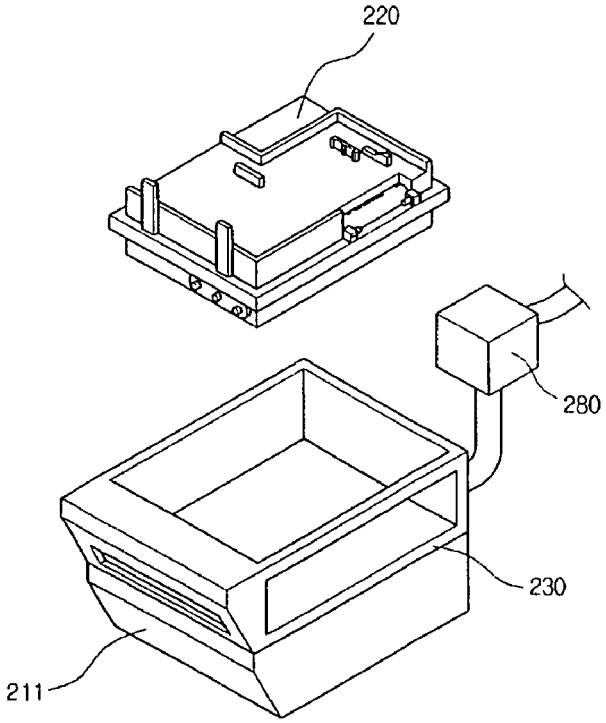

[Fig. 8]
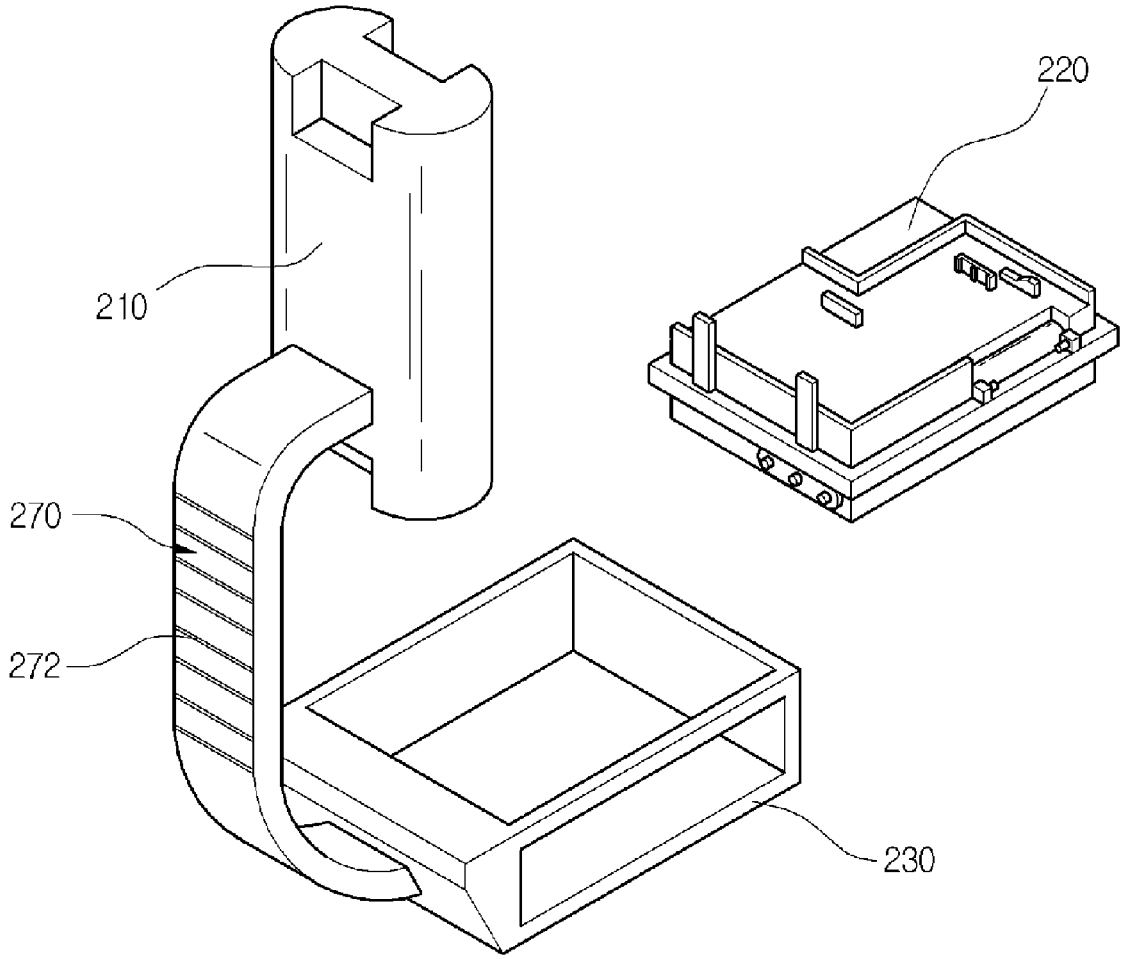

CLOTHES REFRESHING APPARATUS AND METHOD FOR CONTROLLING THE SAME

CROSS-REFERENCE TO RELATED APPLICATION

This application claims the benefit of Korean Patent Application No. 10-2006-0037889, filed in Korea on Apr. 27, 2006, the entirety of which is incorporated herein by reference.

TECHNICAL FIELD

This relates to a fabric care apparatus, and in particular, to a fabric refreshing apparatus.

BACKGROUND ART

A fabric refreshing apparatus is an appliance that has a refreshing function for removing smells or wrinkles from fabric articles stored therein.

By removing odor particles and wrinkles using the refreshing function, the fabric articles in the fabric refreshing apparatus may appear to be freshly cleaned and/or ironed.

The refreshing apparatus may use a condensing method or a discharging method based on a selected refreshing function. Specifically, the condensing method circulates steam inside the refreshing apparatus. The discharging method refreshes the fabric articles by using steam and then discharges the steam.

The refreshing apparatus includes an inner case for forming a receiving compartment, and a steam generator for generating steam. The steam generator includes a heater. An additional water supplying line or a water tank is connected to the steam generator for supplying water. The supplied water is heated by the heater and then is changed into steam. The steam is supplied into the receiving compartment to remove odors or wrinkles from fabric articles therein.

SUMMARY

Accordingly, embodiments are directed to a refreshing apparatus that substantially obviates one or more problems due to limitations and disadvantages of the related art.

An object is to provide a refreshing apparatus with an improved the layout for each part in order to manufacture a compact product and provide a space for long fabric articles.

Another object is to provide a refreshing apparatus including a slim external appearance.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

To achieve these objects and other advantages and in accordance with embodiments as broadly described herein, there is provided a refreshing apparatus including a case, a receiving compartment formed in the case to receive fabric articles, a steam generator supplying steam to the fabric articles in the receiving compartment, a water tank supplying water into the steam generator, and a drain tank collecting remaining water in the steam generator.

In another embodiment, there is provided a refreshing apparatus including an inner case and an external case, a receiving compartment formed in the internal case to receive fabric articles, a steam generator supplying steam to the fabric articles received in the receiving compartment, a water tank supplying water to the steam generator, a condenser disposed between the internal and external cases which are a flowing passage of the steam discharged from the steam generator, and a drain tank collecting condensed water formed passing through the condenser.

In a refreshing apparatus as embodied and broadly described herein, the size of the refreshing apparatus is manufactured to be compact and its receiving efficiency is improved.

According to a refreshing apparatus as embodied and broadly described herein and a method for controlling the same, a condensed water can be prevented, which is formed on the inner circumference of a receiving space or the inner circumference of a door in the refreshing apparatus during a refreshing process.

Additionally, condensed water is not generated on an inner circumference of a receiving space and an inner circumference of a door during a refreshing process.

Additionally, since condensed water does not occur in a receiving space, dry efficiency for clothes improves and a major cause for bacteria propagation can be removed.

It is to be understood that both the foregoing general description and the following detailed description are exemplary and explanatory and are intended to provide further explanation of the refreshing apparatus as claimed.

BRIEF DESCRIPTION OF THE DRAWINGS

FIG. 1 is a front perspective view of a refreshing apparatus according to embodiments as broadly described herein;

FIG. 2 is a cutaway perspective view of a rear structure of the refreshing apparatus shown in FIG. 1;

FIG. 3 is a sectional view of a condenser and a discharge port of the refreshing apparatus shown in FIG. 1;

FIG. 4 is a perspective view of a refreshing unit of the refreshing apparatus shown in FIG. 1;

FIG. 5 is an exploded perspective view of the refreshing unit shown in FIG. 1;

FIG. 6 is a schematic fluid flow diagram for the refreshing unit shown in FIG. 1;

FIG. 7 is a perspective view of a steam generator of the refreshing apparatus shown in FIG. 1, according to another embodiment as broadly described herein; and FIG. 8 is a perspective view of a steam generator of the refreshing apparatus shown in FIG. 1, according to further another embodiment as broadly described herein.

DETAILED DESCRIPTION

Reference will now be made in detail to alternative embodiments, examples of which are illustrated in the accompanying drawings. Wherever possible, the same reference numbers will be used throughout the drawings to refer to the same or like parts.

A specific embodiment will be described based on a condensing type, but the refreshing apparatus as embodied and broadly described herein is not limited to a condensing type and may be applied to a discharging type.

FIG. 1 is a front perspective view of a refreshing apparatus.

Referring to FIG. 1, a refreshing apparatus 100 as embodied and broadly described herein may include a main body 80 that has a receiving compartment 130 formed therein, a door 101 rotatably mounted on the front of the main body 80 by a hinge 102, and a refreshing unit 200 provided on one side of the main body 80 to provide steam and hot air to the receiving compartment 130. Specifically, the main body 80 may include an external case 110 and an internal case 120 disposed inside the external case 110. The external case 110 and the internal case 120 may be spaced a predetermined interval apart from each other. As shown in FIG. 2, heat insulator 140 may be provided in the space formed between the external case 110 and the internal case 120 to minimize heat exchange between the receiving compartment 130 and the outside.

The refreshing unit 200 may be positioned at a bottom side portion of the main body 80, as shown in FIG. 1. In the embodiment shown in FIGS. 1 and 2, a portion of the inner side of the inner case 120 may extend inward toward the receiving compartment 130 to form a mechanical room 300 in this portion of the main body 80 between the internal case 120 and the external case 110 to receive the refreshing unit 200. A fluid supply tank 210 may be provided on a side of the inner case 120 at the mechanical room 300, as shown in FIG. 1. A discharge port 302 for discharging dry air, a discharge port 303 for discharging steam, and a drain hole 304 for draining condensed fluid from the bottom of the receiving compartment 130 may also be provided on the inner case 120, at a portion thereof forming the mechanical room 300. Other locations may also be appropriate. The tank 210 is inserted into a support sleeve 301 that protrudes in a cylindrical shape from the inner case 120. A drain tank 230 is provided on the bottom of the mechanical room 300 to collect condensed fluid. If a front of the drain tank 230 is exposed and accessible at a front bottom portion of the refreshing apparatus 100, as shown in FIG. 1, the drain tank 230 may be easily removed, emptied and replaced.

Additionally, the door 101 is attached to one side edge of the main body 80 to be rotatable by using a hinge 102.

Heaters, such as plate-type heaters 400 and 410 are mounted on the side of the inner case 120 and the inner surface of the door 101. Temperature sensors 420 and 421 are mounted around the plate-type heaters 400 and 410. In certain instances steam may be easily condensed in an upper portion of the receiving compartment 130, and in particular, on surfaces of the inner case 120 and the door 101. Thus, the heaters 400 and 410 and temperature sensors 420 and 421 may be used to alleviate the condensation problem. More specifically, the temperature sensors 420 and 421 may sense a temperature near the corresponding heater 400 and 410, and the heaters 400 and 410 may be turned on and off based on the sensed temperatures.

Additionally, a condenser 122 as shown in FIG. 2 is provided at the rear of the main body 80. The condenser 122 condenses flowing steam from the receiving compartment 130.

Referring to FIGS. 2 and 3, a structure for condensing steam is provided at the rear of the main body 80 of the refreshing apparatus 100. Specifically, a condenser 122, where steam and air are falling, is formed between the inner rear surface of the external case 110 and the outer rear surface of the internal case 120. A steam discharge port 123 is formed at an upper rear of the inner case 120 to discharge steam from the receiving compartment 130.

More specifically, the upper rear of the inner case 120 having the steam discharge port 123 is slanted toward the bottom at a predetermined angle such that the discharged steam flows smoothly into the condenser 122.

Here, the steam is in a vapor state and easily ascends toward the top of the receiving compartment 130. Therefore, the steam discharge port 123 may be formed on the top of the refreshing apparatus 100.

A partition wall 125 is horizontally formed on the top of the inner case 120, and prevents the steam discharged through the steam discharge port 123 from flowing toward the front of the main body 80.

Guide ribs 126 extend from opposite ends of the partition wall 125 to the rear of the inner case 120. Specifically, the guide ribs 126 guide the steam discharged through the steam discharge port 123 to smoothly fall toward the bottom of the condenser 122. The top of the partition wall 125 and the guide ribs 126 closely contact the inner surface of the external case 110, thereby preventing the steam from being leaked to the outside.

The steam flowing into the condenser 122 through the discharge port 123 falls from the top to the bottom of the condenser 122 and is condensed. Since the steam is in a high temperature vapor state, the steam exchanges heat with external air using heat conductivity provided through the external case 110. To improve heat conductivity efficiency, a plurality of condensation pins 111 are arranged on the inner surface of the external case 110. The condensation pins 111 may be formed as recesses in a corresponding portion of the external case 110, or the outer surface of the external case 110 is flat and its inner surface protrudes through a forming process. The size of the heat exchange area increases due to the condensation pins 111 and also length of a condensation passage increases. Condensation pins 121 similar to the condensation pins 111 formed on the external case 110 may be formed on the inner case 120.

That is, the condensation pins 111 and 121 are formed slanted toward the bottom, and arranged alternately on the left and right of the external case 110. Since a passage through which the steam descends has a zigzag shape, a condensation passage becomes longer compared to a straight line shape. Since the condensation passage becomes longer, a heat exchange time also becomes longer.

The condenser 122 has a shape in which the steam is concentrated to one point in the bottom due to the guide rib 126.

Specifically, the bottom of the guide rib 126 is formed curved toward the edge of one side of the internal case 120. Two guide ribs 126 extend from the both ends of the partition wall 125 toward the bottom and meet each other at the edge of the inner case 120. A condensed water discharge port 251 is formed at the point where the guide ribs 126 meet each other. The condensed water discharge port 251 is connected to the drain tank 230 through a hose. A guide duct 250 is provided around the point where the two guide ribs 126 meet to guide the descending steam toward a drying duct 240 that leads back into the refreshing unit 200. A suction port 244 of the drying duct 240 is connected to the guide duct 250 such that a portion of the steam flows into the drying duct 240 during a steam supplying process. The suction port 244 is a passage where dry air circulates during a drying process. Structures and functions of the drying duct 240 and the guide duct 250 will be described in more detail with reference to drawings.

FIG. 4 is a partial perspective view of a refreshing unit mounted in a refreshing apparatus. FIG. 5 is an exploded perspective view of the refreshing unit.

Referring to FIGS. 4 and 5, the refreshing unit 200 includes a water tank 210 supplying water for generating steam, a steam generator 220 generating steam with the water from the water tank 210, a drain tank 230 collecting any water remaining in the water tank 210 and the steam generator 220 and condensed water generated during a steam supplying process, and a drying duct 240 supplying hot air during a drying process. The refreshing unit 200 is received in the mechanical room 300.

Specifically, the water tank 210 stores a predetermined amount of water therein and supplies the water to the steam generator 220. The water tank 210 is removably received in a support sleeve 301. Accordingly, when the water stored in the water tank 210 is depleted, the water tank 210 can be easily separated for re-supplying.

The steam generator 220 receives the water from the water tank 210 to generate steam. The steam generator 220 includes a heater 221 to change the water into steam by using the heat generated from the heater 221. The water is supplied from the water tank 210 to the steam generator 220 through a predetermined supply passage, i.e., a hose. Additionally, a water supply port 223 connected to the water tank 210 through the hose, a steam discharge port 222 for discharging the steam, and a drain port 224 for draining the remaining water are formed on one side of the steam generator 220, respectively. Here, the water supply port 223 and the steam discharge port 222 are provided on the top of the steam generator 220. The drain port 224 is provided on the bottom of the steam generator 220.

Additionally, the drain tank 230 is a place where the remaining water in the steam generator 220, condensed water in the condenser 122, and the condensed water falling into the bottom of the receiving compartment 130 are concentrated. The condensed water is collected in the drain tank 230 along a drain passage such as a hose connected to each of drain tanks 230.

Specifically, a first connection port 233 connected to the drain port 224 of the steam generator 220, a second connection port 234 connected to a drain hole 304 in the bottom of the receiving compartment 130, and a third connection port 235 connected to a condensed water discharge port 251 provided at the lower portion of the condenser 122 are formed on one side of the drain tank 230, respectively. In other methods, a cluster is separately provided to collect the water drained through the steam generator 220 and the drain hole 304, and the cluster is connected to the drain tank 230 through the hose. An additional connection port that directly connecting the water tank 210 and the drain tank 230 may be further formed on one side of the drain tank 230 or the clusters.

Bacterial proliferation occurs when water remains stagnant for a long period of time in a storage chamber 231 of the drain tank 230. Furthermore, a portion of the polluted water in the drain tank 230 may be vaporized and then may be delivered back into the receiving compartment 130 during a later refreshing process. Accordingly, the drain tank 230 may be emptied after a predetermined time or periodically.

To satisfy these needs, the drain tank 230 may be removably mounted on the main body at a bottom of the clothes refreshing apparatus 100 and formed as a drawer type container. Then, the drain tank 230 can be easily detached and emptied. A grip groove 232 is formed on the front of the drain tank 230 such that the drain tank 230 can be easily withdrawn.

Additionally, the drying duct 240 heats and circulates air inside the receiving compartment 130. Specifically, the drying duct 240 includes a fan installation unit 241 for providing a drying fan, a heater installation unit 242 having a drying heater 245, and a discharge unit 243 discharging hot air. The discharge unit 243 is connected to the discharge port 302 formed on the side of the inner case 120 constituting the mechanical room 300. A suction port 244 is formed on the front of the fan installation unit 241, and the suction port 244 is connected to the guide duct 250.

According to the above structure, when the drying fan and the drying heater 245 in the drying duct 240 operate, air in the receiving compartment 130 is discharged through a steam discharge port 123 formed on the top of the inner case 120. The discharged air ascends along the condenser 122 and flows into the guide duct 250. The air flowing into the drying duct 240 is suctioned into the drying duct 240 thorough the suction port 244 of the drying duct 240. The suctioned air is heated to a high temperature by using the drying heater 245. Then, an air circulating process is repeated, so that the heated air is discharged into the receiving compartment 130 again through the discharge unit 243 and the discharge port 302.

As shown in FIG. 5 the water tank 210, the steam generator 220, and the drain tank 230 are sequentially stacked. Due to this stacked structure, space that the mechanical room 300 occupies is reduced, and available space in the receiving compartment 130 is increased.

Additionally, according to above-stacked structure, the flow of water in the refreshing unit 200 falls naturally by means of gravity. Accordingly, an additional device is not required for generating the flow of water in the refreshing unit 200. Furthermore, the overall size of the refreshing unit 200 decreases.

FIG. 6 is a schematic fluid flow diagram of water and steam in a refreshing unit as embodied and broadly described herein.

According to an embodiment as broadly described herein, the remaining water in the water tank 210 is collected into the drain tank 230 through the steam generator 220. This will be described in more detail.

Referring to FIG. 6, the water is supplied from a water supplying source to the water tank 210, and the supplied water is supplied to the steam generator 220. A control valve 215 is mounted between the water tank 210 and the steam generator 220. A water level sensor 225 is installed inside the steam generator 220 such that an appropriate amount of water can be supplied to the steam generator 220. In alternative embodiments, the control valve 215 may be installed on a passage connecting the water supplying source and the water tank 210, and the water level sensor 225 may be mounted inside the water tank 210. Additionally, a temperature sensor 226 is mounted inside the steam generator 220 thereby preventing the steam generator 220 from being overheated when a heater continuously operates without sufficient water in the water tank 210. The drain port 224 of the steam generator 220 and the first connection port 223 of the drain tank 230 are connected to each other through a hose.

According to the above structure, the water stored in the water tank 210 is supplied to the steam generator 220 through the water supply port 223. The supplied water is heated and steam is generated by an operation of the heater 221 inserted in the steam generator 220. The generated steam is supplied to the receiving compartment 130 through the steam discharge ports 222 and 303.

Once the steam supplying process is completed, the remaining water in the steam generator 220 is discharged through the drain port 224. The drained water is stored in the storage chamber 231 through the first connection port 233 of the drain tank 230.

Condensed water is discharged through the condensed water discharge port 251 during a steam supplying process. The condensed water is formed when a portion of the steam falls along the condenser 122. The discharged condensed water is collected in the storage chamber 231 through the third connection port 235 of the drain tank 230. Then, a user can withdraw the drain tank 230 for disposal of the accumulated water.

FIG. 7 is a perspective view of an assembly of a steam generator of a refreshing apparatus according to another embodiment as broadly described herein.

Referring to FIG. 7, the water tank 210 is connected to the drain tank 230 through the connection part 240. The connection part 240 may be bent up or down, and grooves 272 can be formed on a plane surface of the connection part 270. The grooves 272 prevent the connection part 270 from slipping through a user's fingers when the user grasps the connection part 270.

The steam generator 220 may be interposed between the water tank 210 and the drain tank 230. The connection part 270 may separate the water tank 210 and the drain tank 230 from the steam generator 220.

Additionally, since the user holds and pushes the connection part 270, the water tank 210 and the drain tank 230 can be combined with the steam generator 220.

Since the water tank 210 and the drain tank 230 are handled together using the connection part 270, it is unnecessary to handle the water tank 210 and the drain tank 230 separately.

FIG. 8 is a perspective view of an assembly of a steam generator according to another embodiment as broadly described herein.

In the embodiment shown in FIG. 8, the water tank 211 and the drain tank 230 can be manufactured as one body. When manufacturing the water tank 211 and the drain tank 230 as one body, the water tank 211 is disposed below the drain tank 230. At this point, the water tank 211 includes a pump 280 to supply water from the water tank 211 to the steam generator 220.

Since the water tank 211 and the drain tank 230 are manufactured as one body, they can be handled together and the size of the refreshing apparatus can be reduced.

Hereinafter, processes of the refreshing apparatus will be described. Here, the processes include a first drying process, a steam supplying process, and re-drying process. Theses processes are exemplary and various other processes may be possible.

First, fabric articles are received in the receiving compartment 130.

During the first drying process, power is applied to the drying duct 240 and external air flows into the drying duct 240. After the flowing air is heated in the drying duct 240 and changes into hot air, the hot air is discharged into the discharge port 302. The discharged hot air is applied to the fabric articles in the receiving compartment 130.

During the steam supplying process, the water in the water tank 211 is supplied to the steam generator 220. The supplied water is heated by the heater 245 of the steam generator 220 and changes into a high temperature steam. This steam is applied to the receiving compartment 130 through a predetermined nozzle.

The steam passing through the fabric articles in the receiving compartment 130 flows into the condenser 122 through the steam discharge port 123. The flowing steam passes through the condenser 1212 and exchanges heat with external air using the rear of the external case 110 as a heat exchanging layer. Then, the steam is condensed and changes into condensed water.

The condensed water is guided by the condensation pins 111 and 121, and flows along opposing walls of the inner case 120 and the external case 110, the walls constituting the condenser 122. The condensed water flows into the drain tank 230 along a predetermined passage. On the other hand, after the steam supplying process is completed, the remaining water in the steam generator 220 flows into the drain tank 230 along a predetermined passage. The user empties the drain tank 230 such that the water in the drain tank 230 can be easily removed from the refreshing apparatus 100.

During the re-drying process, external air flows into the drying duct 240 and changes into hot air. Then the hot air is applied to the receiving compartment 130.

Through the above processes, dirt and wrinkles in the fabric articles positioned in the receiving compartment 130 are removed such that they appear to be freshly cleaned/ironed.

In a refreshing apparatus as embodied and broadly described herein, the size of the refreshing apparatus is compact and its receiving efficiency can be improved.

Additionally, condensed water is not generated on an inner circumference of a receiving space and an inner circumference of a door during a refreshing process.

Additionally, since condensed water does not occur in a receiving space, drying efficiency improves and a major cause for bacteria propagation can be removed.

It will be apparent to those skilled in the art that various modifications and variations can be made to the embodiments as broadly described herein. Thus, it is intended that the embodiments include the modifications and variations provided they come within the scope of the appended claims and their equivalents.

The invention claimed is:

1. A fabric refreshing apparatus, comprising:

a case comprising an inner case that defines a receiving compartment and an outer case that surrounds the inner case;

a steam generator configured to supply steam to the receiving compartment;

a fluid supply configured to supply fluid to the steam generator;

a drain configured to collect residual fluid from the steam generator;

a condenser comprising a passage formed at a rear of the inner case, between the inner case and the outer case, and configured to condense air discharged from the receiving compartment; and a partition wall provided at a top portion of the case extending between the inner and outer cases, wherein the partition wall is configured to direct air discharged from the receiving compartment into the condenser and to prevent air discharged from the receiving compartment from flowing into a top portion of the case formed between the inner and outer cases.

2. The apparatus of claim 1, wherein fluid from the fluid supply is drawn into the steam generator by gravity, and fluid from the steam generator is drawn into the drain by gravity.

3. The apparatus of claim 1, wherein the fluid supply, the steam generator and the drain are vertically stacked relative to the case.

4. The apparatus of claim 3, wherein the fluid supply is positioned above the steam generator and the steam generator is positioned above the drain.

5. The apparatus of claim 1, wherein the fluid supply, the steam generator and the drain are positioned on one side of the case.

6. The apparatus of claim 1, wherein the drain is configured to receive condensed fluid from the condenser.

7. The apparatus of claim 1, further comprising a pair of guide ribs, wherein the guide ribs extend between the inner and outer cases, and wherein the guide ribs are configured to prevent air discharged from the receiving compartment and air flowing through the condenser from flowing into opposite side portions of the case formed between the inner and outer cases.

8. The apparatus of claim 7, wherein the pair of guide ribs extend from opposite ends of the partition wall and downward along opposite vertical sides of the condenser.

9. The apparatus of claim 7, wherein lower ends of the guide ribs are slanted towards a central rear portion of the case so as to direct fluid through a discharge port and into the drain.

10. The apparatus of claim 1, wherein the condenser further comprises a plurality of first condensation pins provided with the inner case and a plurality of second condensation pins provided with the outer case.

11. The apparatus of claim 10, wherein the plurality of first condensation pins extend outward from an outer rear surface of the inner case towards the outer case, and the plurality of second condensation pins extend outward from an inner rear surface of the outer case towards the inner case.

12. The apparatus of claim 11, wherein the plurality of first condensation pins are substantially aligned with the plurality of second condensation pins so as to form a zig zag pattern in the passage.

13. The apparatus of claim 12, wherein the outer rear surface of the inner case and the inner rear surface of the outer case together with the plurality of first and second condensation pins respectively formed thereon define a heat exchange area of the condenser.

14. The apparatus of claim 1, further comprising a connection part configured to connect the fluid supply to the drain.

15. The apparatus of claim 14, wherein the fluid supply, the connection part and the drain are integrally formed.

16. The apparatus of claim 15, wherein the fluid supply comprises a pump configured to supply fluid to the steam generator.

17. The apparatus of claim 1, wherein the fluid supply comprises a tank that is detachably coupled to the case.

18. The apparatus of claim 17, wherein the drain comprises a tank having a grip hole provided on a front portion thereof.

19. The apparatus of claim 1, further comprising a drying duct provided between the fluid supply and the steam generator, wherein the drying duct is configured to supply hot air to the receiving compartment during a drying operation.

20. A fabric refreshing apparatus, comprising:

a case comprising an inner case that defines a receiving compartment and an outer case that surrounds the inner case;

a steam generator configured to supply steam to the receiving compartment;

a fluid supply configured to supply fluid to the steam generator;

a drain configured to collect residual fluid from the steam generator; and a condenser, comprising:

a passage formed at a rear of the inner case, between the inner case and the outer case, and configured to condense air discharged from the receiving compartment;

a plurality of first condensation pins provided with the inner case; and a plurality of second condensation pins provided with the outer case.

* * * * *